United States Patent [19]

Boyd

[11] 4,309,263

[45] Jan. 5, 1982

[54] CATHODIC CLAMP APPARATUS

[76] Inventor: Danny R. Boyd, 201 Kurzweg St., Lafayette, La. 70505

[21] Appl. No.: 137,437

[22] Filed: Apr. 3, 1980

[51] Int. Cl.[3] ..... C23F 13/00; A47B 96/06; B01D 13/02

[52] U.S. Cl. ..... 204/197; 204/147; 248/231; 307/95

[58] Field of Search ..... 204/147, 196, 197; 307/95; 248/231

[56] References Cited

U.S. PATENT DOCUMENTS

| | | | |
|---|---|---|---|
| 820,105 | 5/1906 | Frazier | 204/197 |
| 1,113,781 | 10/1914 | Griffin | 248/231 X |
| 1,432,561 | 10/1922 | Johnson | 248/231 X |
| 1,849,789 | 3/1932 | Coffing | 248/231 |
| 1,883,935 | 10/1932 | Kelley . | |
| 2,493,687 | 1/1950 | Mott | 254/195 |
| 2,870,079 | 1/1959 | McCall | 204/197 |
| 3,241,800 | 3/1966 | Richter | 248/231 |
| 3,553,094 | 1/1971 | Scott et al. | 204/197 |
| 3,664,621 | 5/1972 | Savoie | 248/74 R |
| 3,921,238 | 11/1975 | Johnson | 9/8 R |
| 4,089,767 | 5/1978 | Sabins | 204/197 |
| 4,140,614 | 2/1979 | McKie | 204/197 |

*Primary Examiner*—F. Edmundson

*Attorney, Agent, or Firm*—Charles C. Garvey, Jr.

[57] ABSTRACT

A clamp apparatus is provided for use in securing cathodic protection, single anodes, double anodes, riser clamps and the like to the offshore drilling platforms and the like in a marine environment. The apparatus provides a U-shaped channel for fitting against the surface of, for example, the platform leg with a first section extending angularly out from the wall portion of the channel, and a second section extending out from the second wall of the channel. A chain bolt connector is inserted into a provided hole in the first plate section with the chain wrapped around the leg of the drilling platform and end chain links then inserted into a keyhole in the second plate extension and locked in by a movable plate. The nut bolt is then tightened to secure the apparatus against the leg of a platform. A set screw makes contact with the platform leg to complete the cathodic protection circuit. The clamp apparatus can support a single anode or a double anode or be utilized as a riser clamp on the leg of a drilling platform in order to prevent corrosion of the platform leg.

7 Claims, 20 Drawing Figures

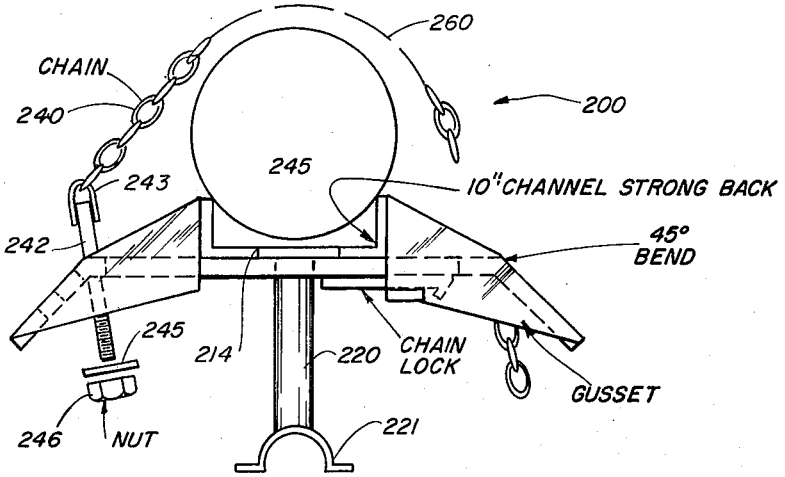
FIG. 15 TOP VIEW
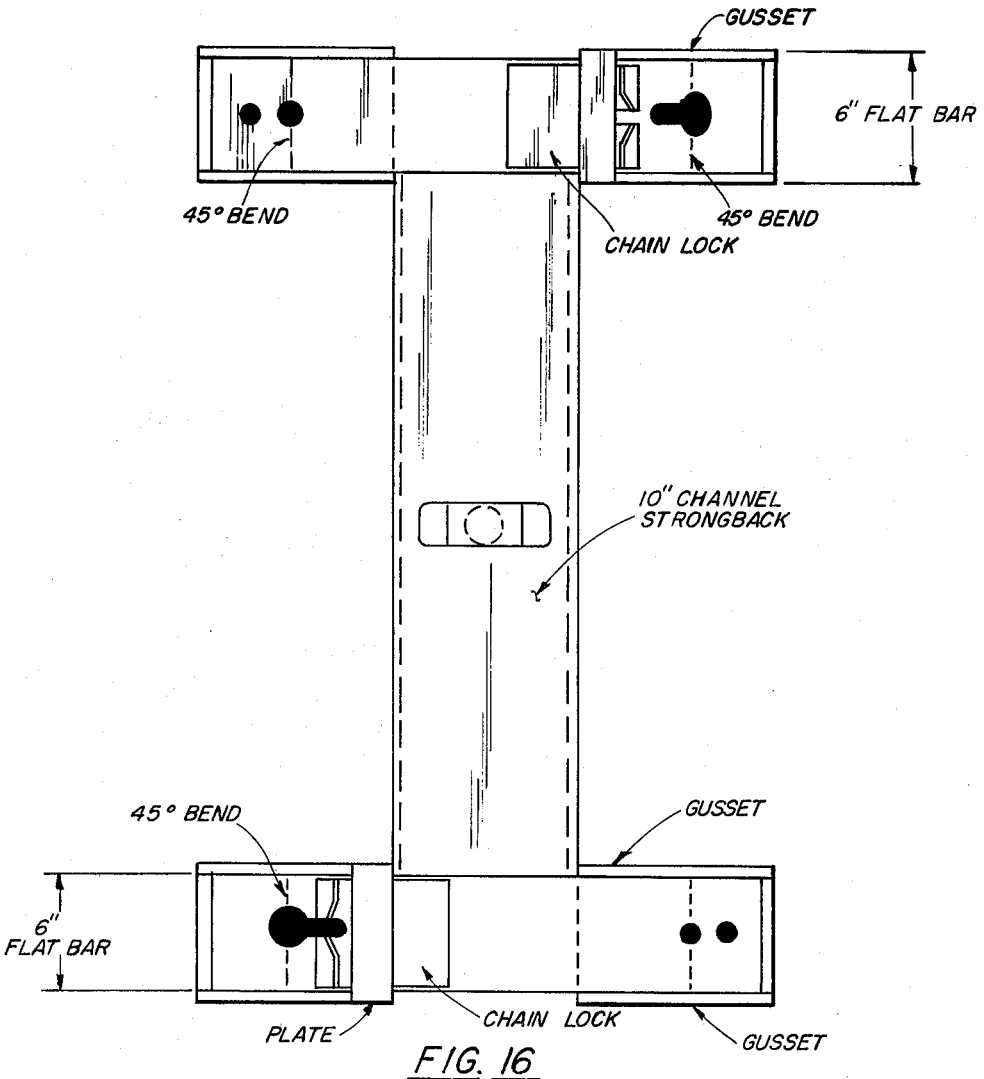
FIG. 16

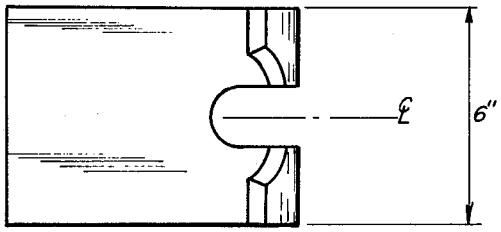
FIG. 17 TOP VIEW
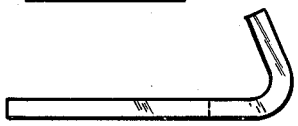
FIG. 17A SIDE VIEW
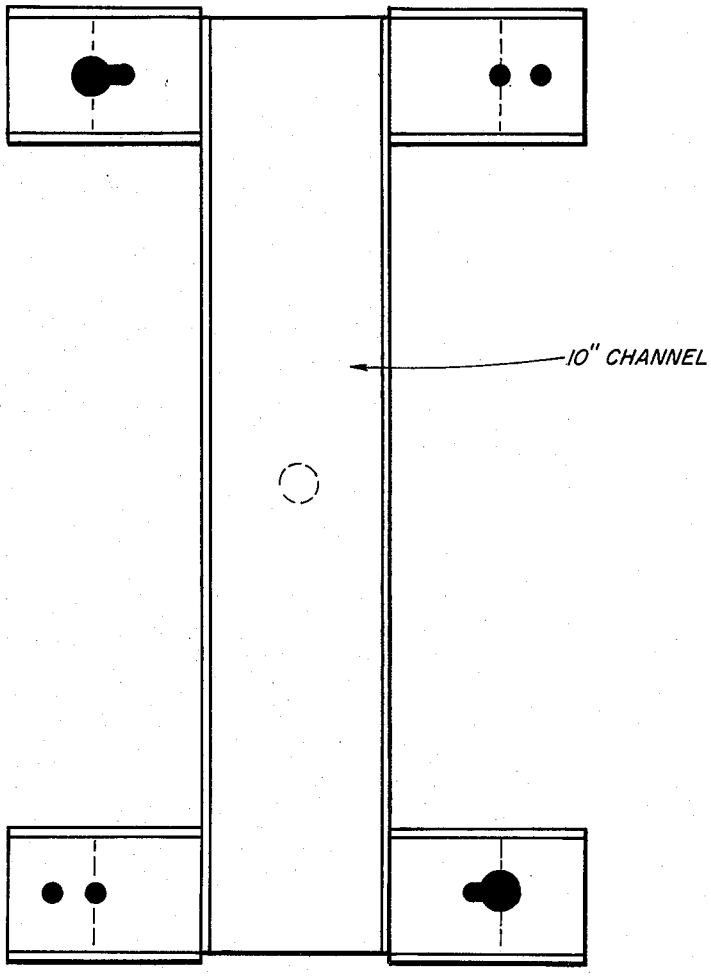
FIG. 18

CATHODIC CLAMP APPARATUS

BACKGROUND OF THE INVENTION

1. Field of the Invention

The present invention relates to cathodic protection clamps and more particularly relates to a clamp apparatus for securing cathodic protection to the leg portions of an offshore marine drilling platform.

2. General Background and Prior Art

In the industry of offshore drilling, one of the most important factors in maintaining the life of the rig platform is to attempt to prevent the legs of the rig platform from corroding through due to the action of the salt sea water. The most successful is to utilize a single or double zinc anode on the platform leg which through the process of electrolysis, transferred in the corrosive process to the platform leg would be transferred to the zinc anode, thus extending the life of the leg.

In order to secure the anode apparatus, there is presently utilized a metallic ring section which hinges around the leg of the platform in a clam effect, opening in half circular or quarters. The metallic encasement must then be brought together around the circumference of the pipe and welded or bolted in place. Through this method of securing single or double anodes onto the pipe leg, one can readily ascertain that the effort involved in moving the sections of the pipe clamp around the first pipe in order to encase it requires extreme labor and those instances where the pipe being encased is on the elevated platform in a marine environment. What is required is that the diver must, in effect, move the sections of the pipe clamp in position to be welded in the closed encased position around a first pipe. The size of the primary pipe often times requires 24 to 36 inch diameters, taking extreme effort in order to move the huge joints into position for clamping so that the single or double anode sections may be placed upon the leg of the platform.

Another problem in utilizing the present state of the art, is the fact that pipe clamp sections must be moved out into marine environment via transport boats, such boats having to go out sometimes over 100 miles offshore in order to reach the offshore platforms. Even with the very large boats, due to the huge size of prior art devices, a limited number of devices may be carried at one time when including the tools necessary to secure them against the rig leg and the divers who must perform the work.

A rig platform, depending on its size, may use on the order of one hundred (100) anode clamps for proper cathodic protection. It may then take numerous trips by the transport boat and excessive amounts of time in order to finally get a platform properly protected against saltwater corrosion.

Another prior art problem involves the encrustation of marine growth on offshore platform leg portions such as barnacles and their requisite removal before clamps can be affixed. The prior art type U-clamps or U-bolts are factory sized and standardized to affix to a round pipe when the pipe is clean and uniformly cylindrical in its shape. This unfortunately is not the way many existing platform legs are shaped due to the encrustations, as marine growth, barnacles, seaweed or like which grow on the platform legs particularly in the splash zone area. The encrustations add diameter to the legs or piling or risers as the case may be, making U-bolts or U-clamps not properly fit since such bolts or clamps are usually selected by inspecting construction drawings or platform specifications based upon leg or pipe sizes as when constructed.

The prior art has dealt with the problem of encrustations at the splash zone by mechanically removing the encrustations at a spot on the platform leg where the anode assembly would be desirably attached. Prior art methods such as scraping, chipping and like manual mechanical removal has been used employing divers or like offshore workers.

The present invention solves these prior art problems and shortcomings in a simple, inexpensive manner. The present invention provides an adjustable clamp assembly providing a U-shaped channel for fitting against the surface of, for example, the platform leg with a first section extending angularly out from the wall portion of the channel, and a second section extending out from the second wall of the channel. A chain bolt connector is inserted into a provided hole in the first plate section with the chain wrapped around the leg of the drilling platform and end chain links then inserted into a keyhole in the second plate extension and locked in by a movable plate. The nut bolt is then tightened to secure the apparatus against the leg of a platform. A set screw makes contact with the platform leg to complete the cathodic protection circuit. The clamp apparatus can support a single anode or a double anode or be utilized as a riser clamp on the leg of a drilling platform in order to prevent corrosion of the platform leg.

The adjustable chain allows the single clamp apparatus to be adjustably affixed to platform legs even when encrusted with marine growth, protective coatings, or like diameter changes of the normal leg diameter. The rise of various U-clamps to fit particular leg sizes is eliminated as is the need for mechanical removal of such encrusted or coated material on the platform legs, risers, and the like.

The present invention thus provides a clamp apparatus which is light, easily secured against the leg of a platform without the need for mechanical removal of encrusted marine growth and in most cases by a single diver. Presently, two or three divers are required per prior art type clamp while several or three clamps could be secured on the platform leg at one time reducing the time involved significantly and the expense also.

It is therefore one object of the apparatus of the present invention to provide a clamp means for securing against the leg of a drilling platform which is lightweight and easily and compactly moved about from point of origin to point of designation.

It is another object of the apparatus of the present invention to provide a clamp apparatus for securing against the leg of a drilling platform which is lightweight and can be attached to the platform leg by the use of a single diver.

It is another object of the apparatus of the present invention to provide a clamp means through which a single anode or double anode or riser can be secured to the leg of a drilling platform, the use of a single chain being wrapped around the leg of the platform and secured tightly around that leg.

It is another object of the apparatus of the present invention to provide a clamp means for securing a clamp against the leg of a drilling platform which is so constructed so that the clamp may be secured against various diameter pipes while maintaining its secure position against whatever diameter size pipe it is set against.

Yet another object of the present invention is to provide a clamp apparatus which has an adjustability, allowing attachment to various diameter platform legs, even those encrusted with marine growth and the like.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein:

FIG. 15 is a top view of the preferred embodiment of the apparatus of the present invention embodying a riser clamp;

FIG. 16 is a front view of the clamp apparatus of FIG. 15;

FIGS. 17 and 17A are top and side views of the chain lock portion of the preferred embodiment of the apparatus of the present invention as illustrated in FIGS. 14–16;

FIG. 18 is a rear view of the alternative embodiment of the apparatus of the present invention embodying the clamp as shown in FIGS. 14–16.

DETAILED DESCRIPTION OF THE PREFERRED EMBODIMENT

Figure 1:
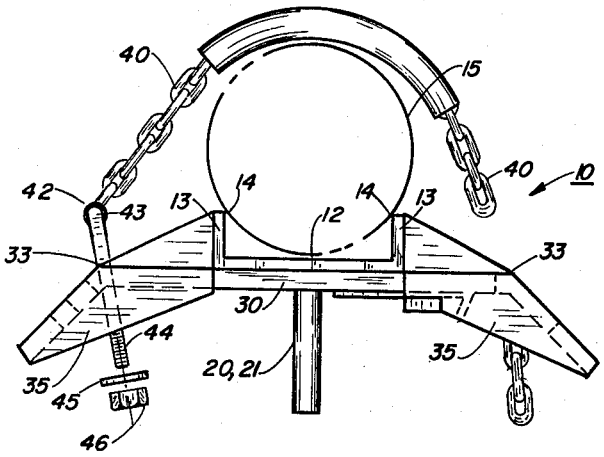
FIG. 1 is a top view of the preferred embodiment of the apparatus of the present invention as attached to a pipe or a marine platform leg portion.

FIG. 1 best shows the preferred embodiment of the apparatus of the present invention designated generally by the numeral 10.

In FIG. 1, there can be seen a clamp apparatus 10 being attached during use to, for example, the leg 15 portion of a drilling platform or the like. Such legs 15 are generally large metallic pipe members being welded together to form a jacket or rig or platform as the structure is variously termed in the art.

The view of FIG. 1 provides a top view illustrating one single leg member 15 with the clamp apparatus 10 attached thereto during operation.

Note that a rearmost channel member 12 abuts leg 15 with flanges 13 thereof being rearwardly directed. The flanges 13 of channel 12 would attach frictionally at points 14 to leg 15.

Figure 2:
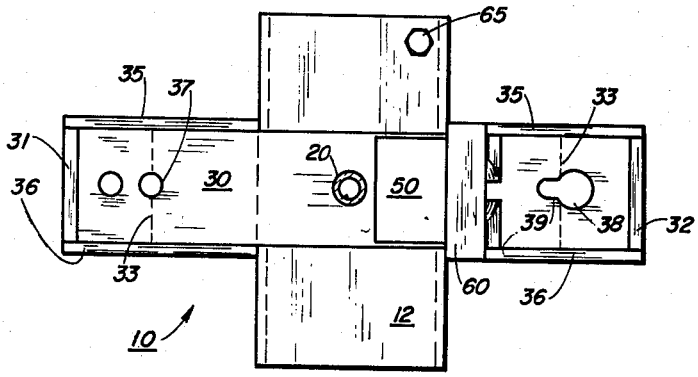
FIG. 2 is a front view of the clamp apparatus of FIG. 1.
Figure 2A:
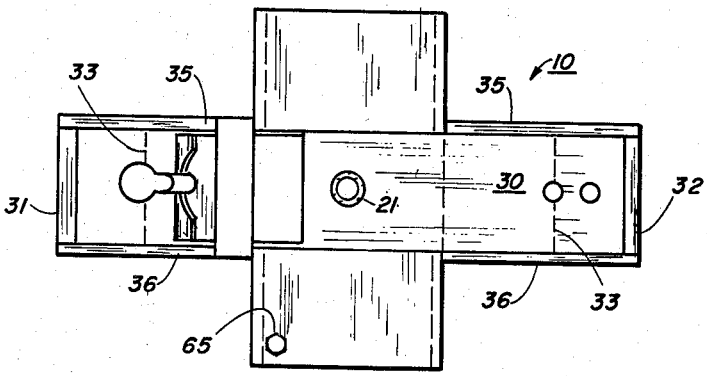
FIG. 2A is an alternative construction of the clamp of FIGS. 1 and 2.

In FIG. 2, channel 12 is seen in a front view of clamp 10. Note that FIGS. 2 and 2A represent together a pair of clamps 10 which would be so arranged during operation vertically or diagonally when attached to a vertical or diagonal leg member 15 as the case may be. The anode hangers 20, 21 respectively would be, for example, one and a half inch pipe by six inches long to which would be attached conventional zinc anodes at the upper and lower portions respectively of the anode by welding, for example, to hangers 20, 21.

Each hanger 20, 21 is welded or connected in a like fashion to chain anchor plate 30. Chain anchor plate can be seen in FIGS. 1–2A as, for example, a rectangular flat bar member having, for example, forty-five degree (45%) bends at its end portions. Forty-five degree (45%) bends 33 are illustrated by the dotted lines in FIGS. 2 and 2A and can be clearly seen in FIG. 1.

The connection of chain anchor plate 30 to channel 12 would be, for example, by welding or like means. In the preferred embodiment, upper and lower gusset plates 35, 36 would be provided to give a stiffening effect.

Chain anchor plate 30 provides left 31 and right 32 portions respectively. In FIG. 2, the uppermost clamp assembly 10 provides openings for the attachment of chain 40 thereto. At left anchor plate portion 31, there can be seen a pair of openings 37, while right chain anchor plate portion 32 provides an opening 38 having a reduced slot 39 portion contiguous therewith. Opening 38 and slot 39 provide an anchoring opening for the attachment of chain 40 thereto.

Figure 3:
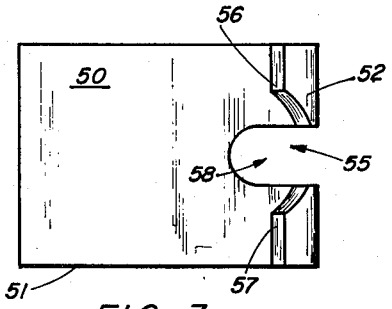
FIGS. 3 and 4 are top and side views of the chain lock portion of the preferred embodiment of the apparatus of the present invention.
Figure 4:
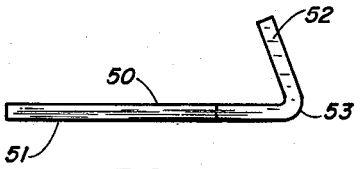

Also seen in FIGS. 2 and 2A is chain lock plate 50 which is more particularly seen in FIGS. 3 and 4.

As will be described in more fully hereinafter, chain of lock 50 is slidably mounted upon chain anchor plate 30 being retained in the sliding position by sleeve 60.

In FIGS. 3 and 4, can be seen top and side views respectively of chain lock 50. In FIG. 4, a side view illustrates plate 50 having an end portion 52 which is curved at forty-five degree (45°) bend 53.

In FIG. 3, a top view illustrates the end portion 52 also having a slot 55 portion which extends inwardly upon the base 51 portion of plate 50 and communicates with the end 52 portion which is angularly orientated with respect to base 51 portion of chain lock 50. The uppermost portion of end 52 is cut out somewhat providing an increased slot size. Notice that a pair of tabs 56, 57 communicate with enlarged slot 58 as best seen in FIG. 3. The enlarged slot 58 provides an area for easily indexing chain 40 into slot 58 while slot 58 itself is somewhat smaller in diameter to form a tight connection with chain 40.

In operation, chain 40 would be thread through opening 39 and attached to both slot 39 and slot 58 of chain lock plate 50. The opposite end portion of chain 40 would be attached at one end portion to anchor bolt 42 which provides an eyelet 43 to which the last link of chain 40 would be affixed. Thus a structural tensile connection between chain 40 and bolt 42 would be accomplished at eyelet 43. During operation, anchor belt 42 would be mounted through either opening 37 depending on the size of the piling or platform leg 15 to which assembly 10 would be attached. The opposite end portion of anchor bolt 42 from eyelet 43 would be for example threaded with the threads 44 being shown in FIG. 1. In order to complete a connection of anchor bolt 42 to anchor plate 30, washer 45 and threaded nut 46 are provided. As with conventional nut and bolt assemblies, nut 46 would threadably attach to the threaded portion 44 of bolt 42. A power wrench, socket wrench or the like could be used to impart rotational force to nut 46 which would then tighten chain 40 once the opposite end portion of chain 40 had been affixed to opening 38 and slot 39 as above described.

Note that a float F is provided in FIG. 1 to that portion of chain 40 which is away from the ends that connect respectively at openings 37 and opening 38. This central portion of chain 40 provides float F which is an aid to the diver or installer of clamp assembly 10. Float F would allow the diver to reach around and easily grab the end portion of the chain which was nearest opening 38. Usually, the bolt and nut assembly above described would be first attached loosely and then chain 40 tightened somewhat and one link of chain 40 placed in slot 39. Thereafter, the diver would tighten nut 46 to achieve the completed connection. Float F merely keeps chain 40 from sinking and allows one individual diver to make the complete installation without the aid of others if desired.

Float F, could be eccentrically mounted. This would prevent a crushing of the innermost portion of Float F once assembly was completed. The eccentric attachment of Float F to chain 40 could be achieved by contacting along one side the cylindrical edge of Float F. In the preferred embodiment Float F would be round with chain 40 contacting one edge portion thereof. In FIG. 1, the arrow 16 indicates the point of attachment of float F and its enclosed chain 40 to leg 15. It should be understood that in FIG. 1 chain 40 is continuous from one end portion to the other and in FIG. 1, float F merely covers chain 40 but a continuous structural connection of chain 40 is maintained throughout. A suitable plastic or foam float material could be used and could be for example cast about chain 40 in desired links and in desired diameters. During this casting process, the eccentricity could be achieved as desired, by for example laying the chain against one edge of the mold before foam was added.

An inspection of FIGS. 2 and 2A shows set screw 65. Set screw 65 is provided to insure a completed circuit between clamp 10 and leg 15. Many times, leg 15 is provided with an entire corrosive coating such as paint, tar, or the like which must be penetrated to achieve a metal to metal contact between clamp 10 and leg 15. Set screw 65 achieves this completion of circuit by cutting through any layers of protective outer coating which is nonconductive and attaching to and contacting the metallic portion of leg 15.

Figure 5:
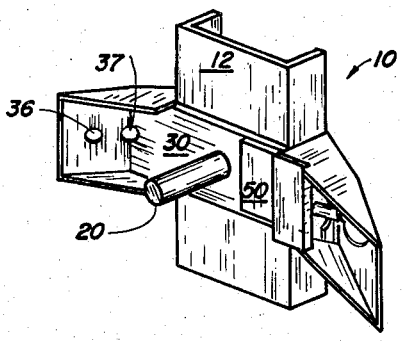
FIGS. 5 and 6 are perspective views of the preferred embodiment of the apparatus of the present invention illustrating alternate configurations thereof.
Figure 6:
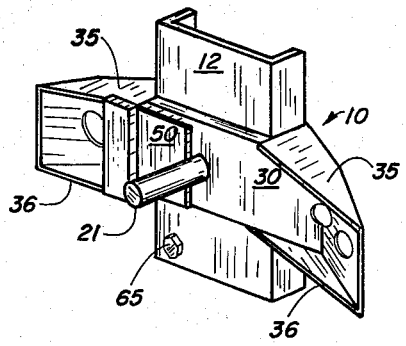

In FIGS. 5 and 6 there can be seen respectively perspective views of the clamps above described with respect to FIGS. 2 and 2A. In FIGS. 5 and 6 as well as in FIGS. 2 and 2A, a pair of clamps 10 are seen and are alternated in their geometric placement.

Figure 7:
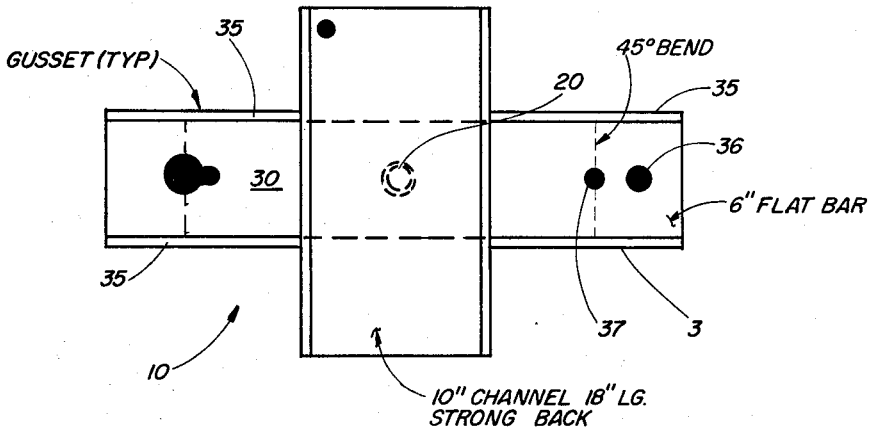
FIG. 7 is a rear view of the clamp apparatus of FIGS. 1–6.
Figure 8:
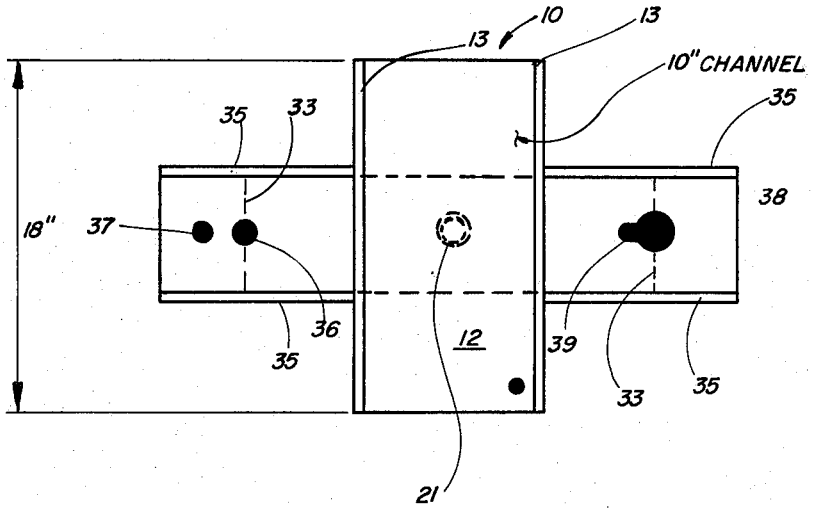
FIG. 8 is another rear view of the clamp apparatus of FIG. 6.

FIGS. 7 and 8 illustrate the preferred embodiment of the apparatus of the present invention providing rear views thereof. Again, a pair of clamps 10 are shown corresponding to the pairs as shown in FIGS. 2 and 2A as well as in FIGS. 5 and 6. The pair is so shown because in operation a pair of clamps 10 would be used so arranged for the holding of a single anode. In operation, an anode would be attached at its respective end portions to hangers 20, 21 as above described.

Figure 9:
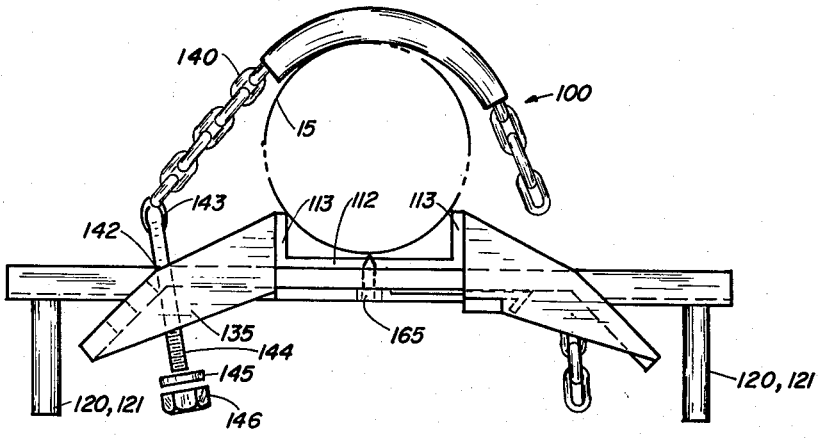
FIG. 9 is a top view of an alternative embodiment of the apparatus of the present invention as used for double anode assemblies.
Figure 10:
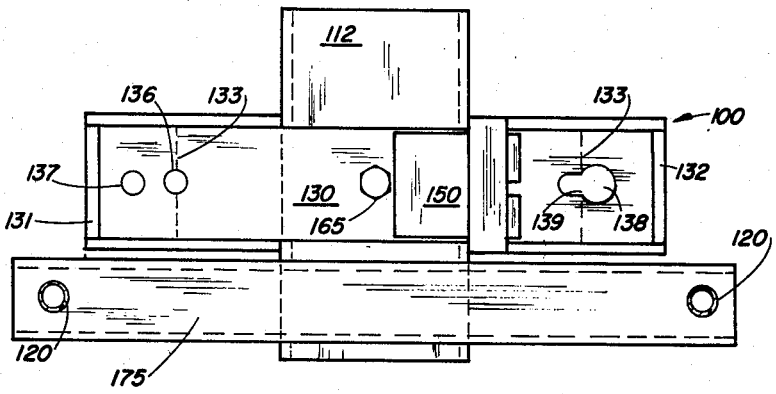
FIGS. 10 and 11 are front views respectively of the double anode clamp arrangement of FIG. 9.
Figure 11:
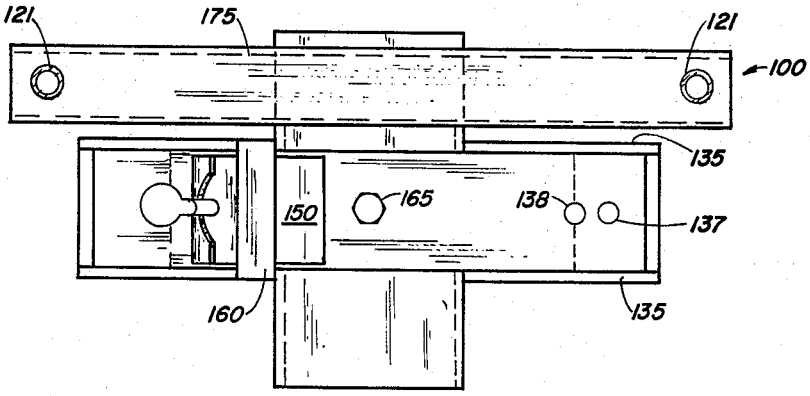

FIGS. 9–13 illustrate an alternative embodiment of the apparatus of the present invention as used for double anode clamp installations. In FIGS. 9 and 10–11, there can be seen top and front views respectively of a pair of clamps designated generally by the numerals 100.

In FIG. 9, platform leg member 15 is as was described with respect to the preferred embodiment of FIG. 1.

A rearmost channel member 112 is seen in FIG. 9 having flange portions 113 which contact leg member 15 at points 114.

FIGS. 10 and 11 show a pair of clamp assemblies 100 arranged vertically as they would appear on a vertical leg 15 of an offshore platform, for example.

In FIGS. 10 and 11, there are seen lateral hanger plates 175 each having a pair of anode hangers 120, 121 respectively.

Also seen attached to channel 112 is anchor plate 130 having left and right portions 131, 132 respectively. Forty-five degree (45°), for example, bends are seen as 133 in FIGS. 10 and 11. Note that left portion 131 of chain anchor plate 130 is seen a pair of openings 137 respectively. The right portion 132 of anchor plate 130 provides opening 138 and communicating therewith slot 139.

Anchor plate 130 is seen in FIGS. 9—11 as having gusset plate 135 which is attached to both anchor plate 130 and the flange 113 portions of channel 112 by means such as welding or the like.

A set screw 165 is provided as was aforedescribed with respect to the embodiment of FIGS. 1–8. Additionally, there is provided a chain lock 150 being constructed similarly with the chain lock of FIGS. 3 and 4.

Anchor bolt 142 provides an eyelet 143 portion for attachment to chain 140 with an end portion 144 being threaded for attachment of washer 45 and nut 146 thereto.

Sleeve 160 retains chain lock 150 in its sliding position.

Figure 12:
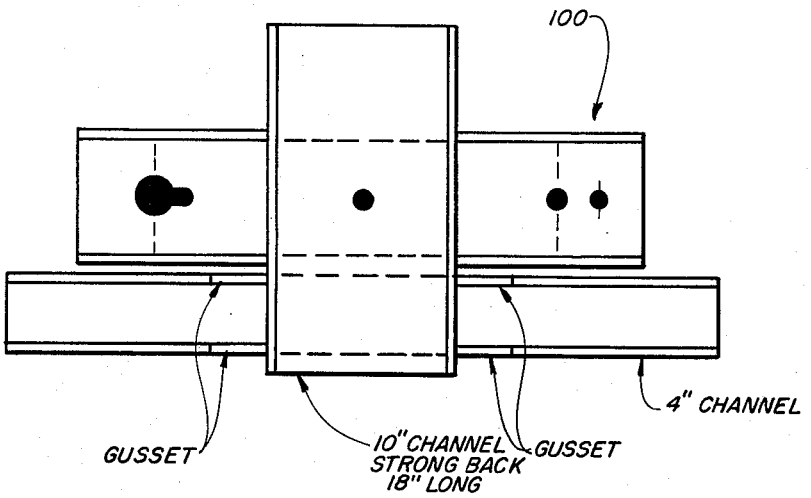
FIGS. 12 and 13 are rear views respectively of the clamp apparatus as shown in FIGS. 10 and 11 respectively.
Figure 13:
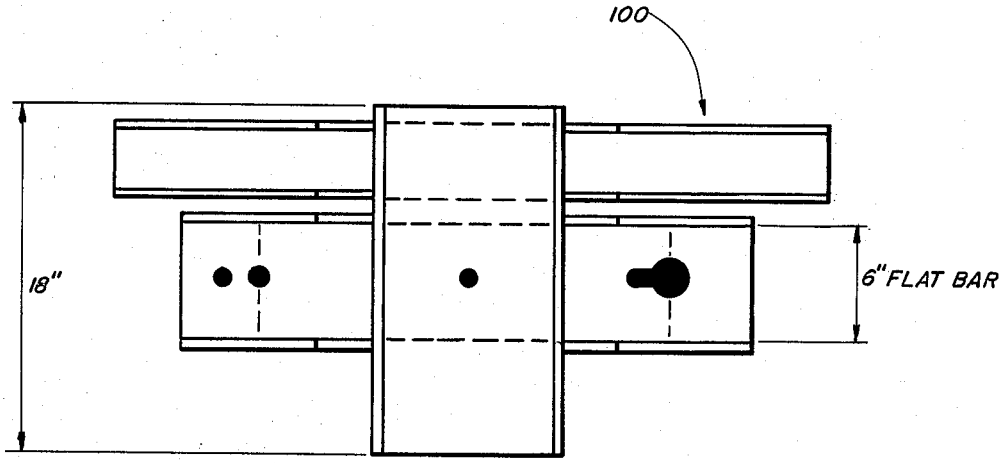

In FIGS. 12 and 13 can be seen rear views of the clamp 100 of FIGS. 10 and 11. The rear views of FIGS. 12 and 13 represent a pair of clamps 100 as would be used normally in the installation of a pair of anodes upon a single platform leg 15 member.

In FIGS. 14–18 there is seen an alternative embodiment of the apparatus of the present invention as used for a riser clamp assembly.

Figure 14:
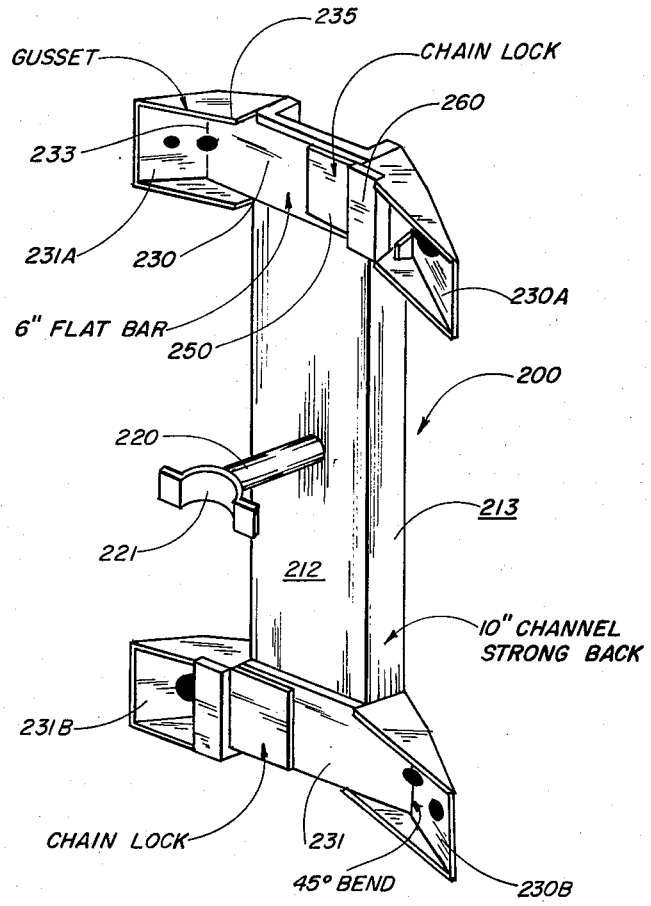
FIG. 14 is a perspective view of the preferred embodiment of the apparatus of the present invention used as a riser clamp.

In FIG. 14, riser clamp assembly 200 is seen having a base channel 212 member provided with flanges 213.

Note that the front face portion of channel 212 which forms the web 214 thereof, there is outwardly extending a riser hanger 220 with a pipe clamp half 221 attached thereto by welding, for example. Note that a semi-circular pipe clamp half 221 is provided with a riser pipe being attached during operation to hanger 220 at clamp 221 by welding, or by clamping using bolts or other like means.

Upper and lower chain anchor plates 230, 231 are provided, each having end portions which are angularly deposed with respect to channel web 214. As with the embodiments of FIGS. 1–13, a preferably forty-five degree (45%) angular bend 233 is provided which creates angular end portions 230A, 230B and 231A, 231B respectively.

Openings 237 allow for the attachment of bolt 242 thereto as will be described more fully hereinafter.

Gusset plate 235 is welded, for example, to chain anchor plate 230 as was described with respect to the preferred embodiments. In like manner to the preferred embodiments, there is provided chain lock 250 and sleeve 260.

In FIG. 15, there is seen a top view of clamp apparatus 200 with chain 240 being attached at one end portion to anchor bolt 242 which is mounted through either opening 236 or 237 being affixed thereto using washer 245 and nut 246. Anchor bolt 242 would be threaded, for example, providing an upper eyelet 243 which is structurally attached to chain 240.

Chain 240 would preferably be coated with a suitable float material such as, for example, polyurathane which would be molded around chain 40 but off-centered. In this way, the chain would float providing easy installation in a marine environment by a diver, for example.

The off-centering of the polyurathane or like float material would allow the chain itself to be placed directly against leg 15 member for a good structural connection thereto.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A clamp assembly comprising:

a. a vertically deposed channel member, the flange portions of said channel member being inwardly directed toward an offshore platform leg member during attachment thereto;

b. a chain anchor plate, connected to said channel member, said anchor plate being substantially rectangular and having angularly set end portions, said angular end portions being directed generally away from said chain anchor plate away from the platform leg to which said assembly is attached during operation;

c. gusset means for stiffening the connection between said channel member and said chain anchor plate;

d. a first opening in one of said angular end portions of said anchor plate;

e. a second opening in the opposite of said angular end portions of said anchor plate, said second opening being provided with an adjacent contiguous chain receptive slot;

f. an anchor bolt structurally but adjustably attached during operation to said first opening;

g. chain means for flexibly surrounding the platform to which said assembly is attached, said chain means being attached at one end portion to said anchor bolt and at the other end portion thereof to said chain anchor plate at one of said second openings being at least partially connected to said chain receptive slot;

h. at least one anode hanger projecting from said assembly and being structurally attached thereto for structurally supporting an anode;

i. cathodic protection means attached during operation to said hanger for providing cathodic protection to at least a portion of a platform leg to which said assembly is attached;

j. means for completing a circuit between said cathodic protection means and an offshore platform leg member to which said assembly is attached.

2. The clamp assembly of claim 1 wherein said anchor bolt provides an eyelet at one end portion attached to said chain means and said anchor bolt is threaded at the opposite end portion thereof and there is further provided a threaded nut attachable to said anchor bolt at said threaded portion.

3. The clamp assembly of claim 1 wherein said chain means is an elongated chain having a plurality of connected links and said chain attaches at one end portion to said anchor bolt and at the other end portion during operation to said chain receptive slot.

4. The clamp assembly of claim 1 wherein said anchor bolt is adjustably attached during operation to said first opening by a threaded bolt which is threadably attached to said anchor bolt, and rotations of said nut adjusts the tension of said chain means about the platform leg member to which the said assembly is attached.

5. The clamp assembly of claim 1 wherein said hanger is a cylindrical pipe welded at one end portion to said anchor plate.

6. The clamp assembly of claim 1 further comprising float means affixed to said chain means for providing buoyancy to said chain means in a marine environment.

7. A clamp assembly for affixing cathodic protections to a marine platform comprising:

a. a metallic marine platform leg member;

b. a metallic frame separate from said leg and attachable thereto;

c. a pair of lateral side portions provided on said frame, each of said side portions being provided with an opening;

d. chain means for flexibly surrounding said platform leg, one end portion of said chain means being attached to one of said openings in one of said lateral side plates;

e. adjustable bolt means attached to the opposite end portion of said chain from said first end portion, said bolt means being adjustably attachable during operation to said side plate to adjust the tension of said chain means about said platform leg;

f. anode hanger means projecting from said frame and being structurally attached thereto for structurally supporting a provided anode member;

g. means for completing a circuit between said hanger means and said platform leg.

* * * * *